US005667201A

United States Patent [19]

Beveridge et al.

[11] Patent Number: 5,667,201

[45] Date of Patent: Sep. 16, 1997

[54] SMELT SPOUT FOR A RECOVERY FURANCE

[75] Inventors: Christopher J. Beveridge, Orleans; Andrew K. Jones, Gloucester, both of Canada

[73] Assignee: Asea Brown Boveri Inc., Canada

[21] Appl. No.: 410,221

[22] Filed: Mar. 24, 1995

[30] Foreign Application Priority Data

Mar. 25, 1994 [CA] Canada ..... 2119963

[51] Int. Cl.[6] ..... C21B 7/14

[52] U.S. Cl. ..... 266/196; 266/218; 266/270; 266/236; 222/590; 222/592

[58] Field of Search ..... 162/30.1, 30.11, 162/239, 240; 422/185, 312; 266/218, 196, 270, 236; 134/166 R; 222/590, 592; 193/2 R, 3, 4

[56] References Cited

U.S. PATENT DOCUMENTS

| | | | |
|---|---|---|---|
| 843,569 | 2/1907 | Luckenbac | 266/196 |
| 1,881,228 | 10/1932 | Pape | 266/196 |
| 2,212,987 | 8/1940 | Jung | 266/196 |
| 4,011,047 | 3/1977 | Tremblay | 422/185 |
| 4,350,325 | 9/1982 | LaBate | 266/196 |
| 4,362,231 | 12/1982 | Meyer | 193/2 R |
| 4,436,518 | 3/1984 | Buss | 193/3 |
| 4,526,351 | 7/1985 | LaBate | 266/196 |
| 4,846,080 | 7/1989 | Ross et al. | 431/188 |
| 5,346,182 | 9/1994 | Kurotobi et al. | 266/236 |
| 5,437,768 | 8/1995 | Smith et al. | 162/239 |

OTHER PUBLICATIONS

IN-657 cast nickel-chromium-niobium alloy for service against fuel-ash corrosion-Engineering Properties, International Nickel Company (undated).

*Primary Examiner*—John M. Sollecito
*Assistant Examiner*—Gregory A. Wilson
*Attorney, Agent, or Firm*—Barnes & Thornburg

[57] ABSTRACT

A smelt spout for a chemical recovery furnace comprises a trough of U-shaped profile fabricated as a casting in a nickel-chromium alloy containing a minor amount of niobium. A system incorporating the spout includes a cooling arrangement which delivers cooling air to the outside surface of the spout.

8 Claims, 4 Drawing Sheets

Section IV–IV

SMELT SPOUT FOR A RECOVERY FURANCE

BACKGROUND OF THE INVENTION a) Field of the Invention

This invention relates to a smelt spout for delivering smelt from a chemical recovery furnace or boiler, and to a delivery system incorporating one or more such spouts.

b) Description of the Prior Art

In the kraft pulping process concentrated used liquor (black liquor) is fed into a recovery furnace wherein the remainder of the water is evaporated and a char composed primarily of sodium sulphate, sodium carbonate and some organic is formed. This char falls to the hearth bed of the furnace which is maintained under reducing conditions and at high temperature to form a smelt consisting essentially of molten sodium sulphide and some sodium sulphate. The hot smelt produced in the recovery furnace pours out of the furnace in a continuous stream on the smelt spout and discharges therefrom into a tank containing an aqueous solution in which it is dissolved. After it leaves the spout, and before it hits the surface of the liquid in the tank, the smelt is broken up into smaller particles by being impinged with a jet of steam or the like.

The service conditions imposed on the smelt spout are extremely severe. Smelt is corrosive and flows at a temperature in the range of 1400° F. to 1700° F. Conventionally, smelt spouts made of metal have been internally cooled by cooling water at a specific flow and temperature. While water cooling prolongs smelt spout life, it also presents a potential safety hazard, since it is a source of water that, in the event of a leak, could cause serious problems. Contact between water in any appreciable quantity and the molten smelt in the chemical recovery boiler bed can result in a violent physical reaction and explosion.

In order to overcome this hazard, non-water cooled smelt spouts have been proposed. U.S. Pat. No. 4,011,047 Tremblay which issued Mar. 8, 1977 describes a smelt spout which is a composite of an outer metal plate covered by a layer of insulating brick and which in turn is covered by a layer of plastic refractory material. This composite spout obviously is quite massive and mounting it can be difficult particularly when one considers that the spout must be supported in a cantilevered fashion from the furnace wall. The Tremblay spout structure also has a barrier end wall damming up and retaining on the spout a certain amount of molten smelt, thus adding to the weight of the spout that must be supported.

SUMMARY OF THE INVENTION

The present invention provides a smelt spout for delivering smelt from a chemical recovery furnace, said spout comprising: a trough of U-shaped profile and fabricated as a casting of a nickel-chromium alloy.

The alloy preferably comprises from 48 to 52% chromium, 1.4 to 1.6% niobium, with the balance being nickel, with minor amounts of trace elements and impurities.

The U-shaped profile of the spout has a curved lower portion that is relatively thick in the central region thereof and tapers in thickness towards the upstanding limbs. The maximum thickness therefore is located in the area of the trough which is most subject to wear.

The invention also provides a system for delivering smelt from a chemical recovery furnace, said system comprising at least one spout having an inlet end mounted in an opening of a wall of said furnace to channel smelt passing through said opening, said spout comprising a casting formed of a refractory and corrosion-resistant metal alloy, said system further including cooling means adapted to deliver a flow of cooling air against the outer surface of said spout.

The cooling means preferably comprises a plenum extending around the outer surface and in a plane normal to the length of the trough, the plenum directing a flow of air against the trough outer surface longitudinally in both directions. The plenum is preferably situated close to the inlet end of the trough.

From another aspect the invention provides a chemical recovery furnace in combination with a smelt delivery system comprising at least one spout having an inlet end that is mounted in an opening in a peripheral wall of the furnace to channel smelt passing through said opening, said spout comprising a casting formed of a refractory and corrosion-resistant metal alloy, said system including a cooling means adapted to deliver a flow of cooling air against the outer surface of said spout at least in a region adjacent the external side of said furnace wall.

The combination may include two spouts carried in respective openings at horizontally spaced locations in the furnace wall. The flow of cooling air to the spouts is independently controllable, which feature can be used to adjust the rate of wear of the spouts to achieve a balanced flow through the two spouts so that the spouts wear at approximately the same rate.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
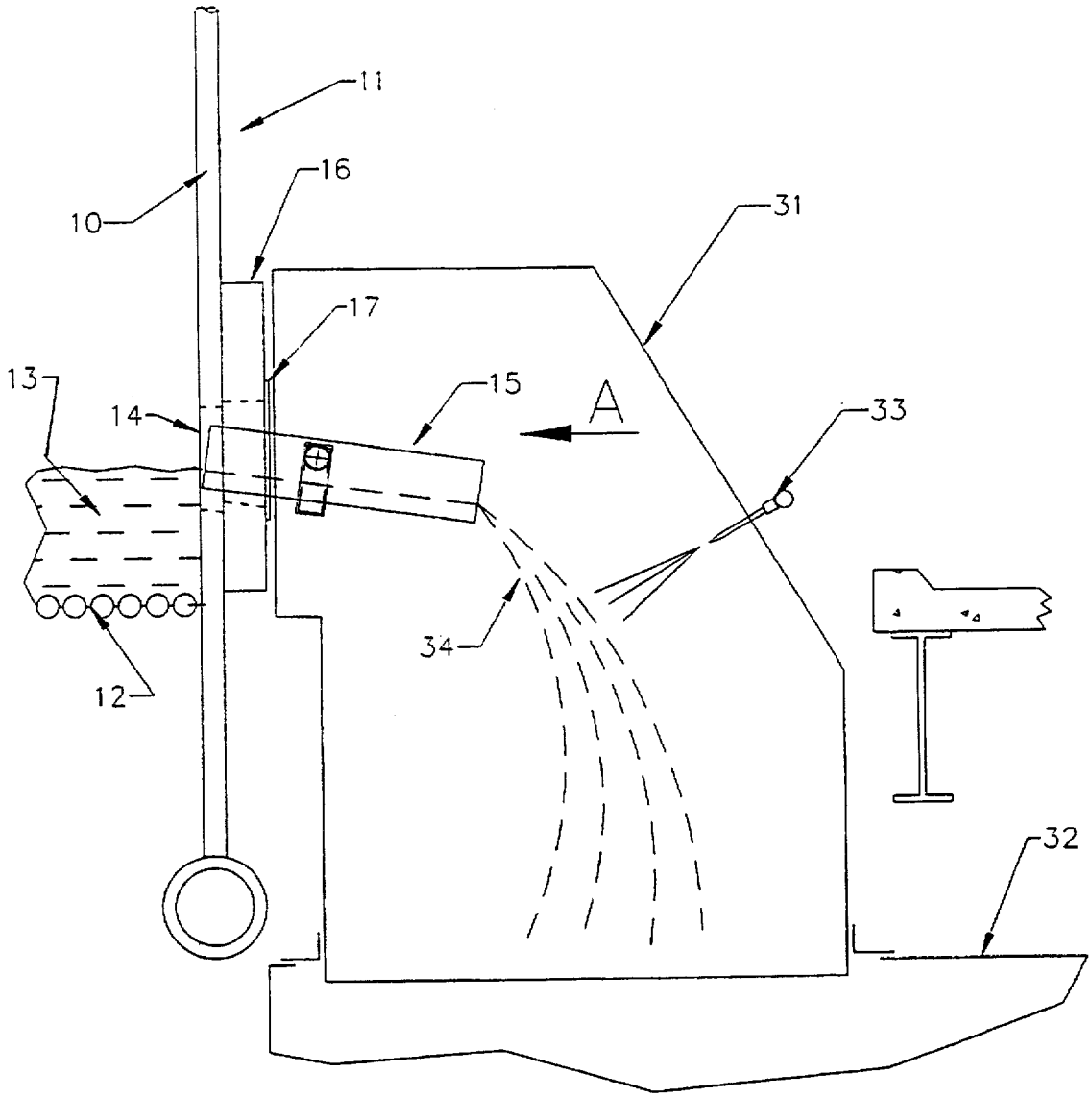
FIG. 1 is a somewhat schematic elevational view of a smelt delivery system in a chemical recovery boiler.
Figure 2:
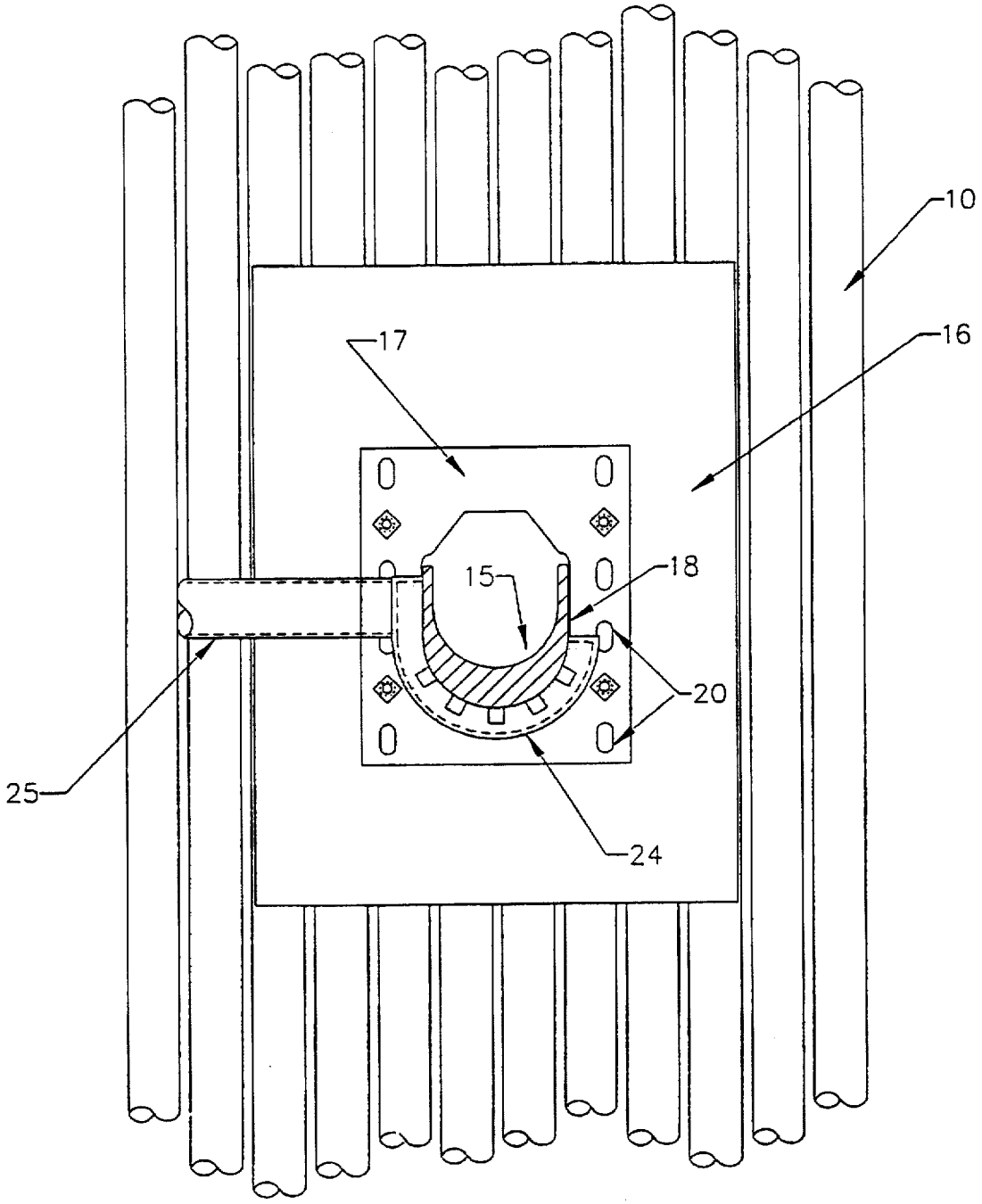
FIG. 2 is a fragmentary view on a larger scale and taken in the direction of the arrow A in FIG. 1.
Figure 5:
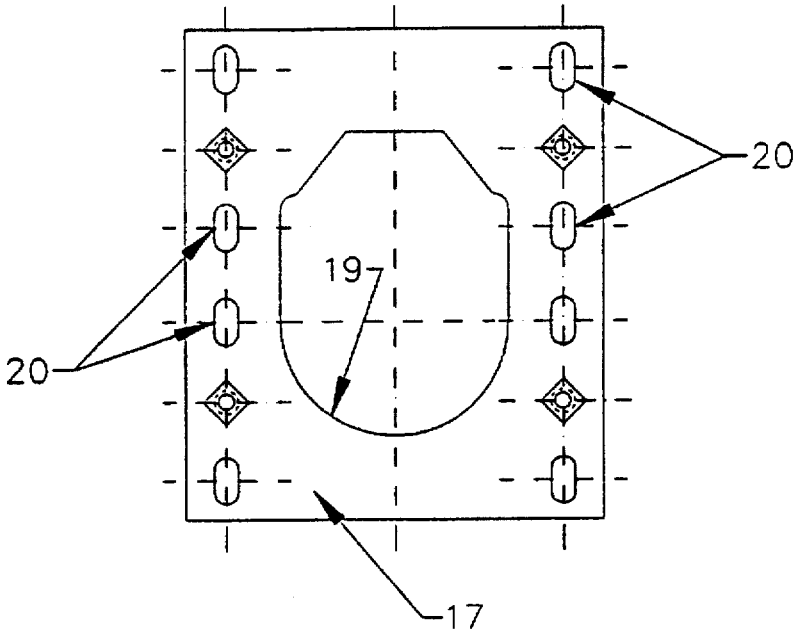
FIG. 5 is an elevational view of a component.

Referring to FIG. 1, the tube wall 10 of a chemical recovery furnace 11 as used in the kraft pulping process, surrounds a hearth bed 12. Concentrated used liquor, otherwise known as black liquor (not shown) is fed into the furnace 11 to produce a char which falls to the hearth bed of the furnace, the latter being maintained under reducing conditions and elevated temperature to form a bed 13 of molten smelt which consists essentially of sodium sulphide and some sodium sulphate. At the level of the smelt bed 13 an opening 14 is defined in the wall 10, a smelt spout 15 being mounted in this opening to remove from the furnace molten smelt from the top of the bed 13. A seal box 16 surrounds the opening 14 and provides an attachment means for a vertically arranged mounting plate 17 which is rigidly connected to the trough section 18 of the spout. The mounting plate 17, which is shown in greater detail in FIG. 5, contains a central aperture 19 through which the trough 18 extends, and a series of vertically elongated slots 20 adapted to receive fasteners such as bolts (not shown) to effect attachment of the plate 17 to the seal box 16. As will be appreciated, the slots 20 allow vertical adjustment of the position of the trough 18 so that it can be matched to the desired level of the smelt bed 13.

Figure 3:
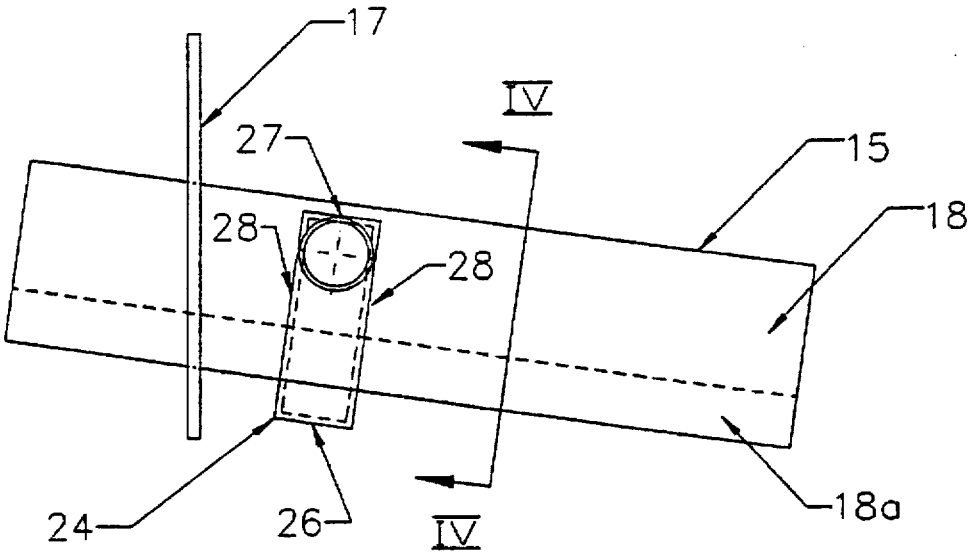
FIG. 3 is an enlarged view illustrating a portion of FIG. 1.

The smelt spout has a cooling system generally indicated at 24 designed to deliver a flow of cooling air against the outside surface of the trough 18, and this system is supplied with air through a duct 25. As better shown in FIG. 3 and 4, the cooling system 24 comprises a hollow three-sided plenum chamber 26 of J-shaped profile (FIG. 4) that extends in a plane at right angles to the length of the trough 18 and lies closely against the external surface of the latter which effectively closes the remaining open longitudinal side of the chamber 26. At its inlet end the chamber 26 has a tubular fitting 27 for connection to the duct 25. Each of the axially spaced side walls 28 is formed with a number of regularly spaced ports 29 adjoining the external surface **18*a* of the trough 18, and directed longitudinally of the trough. The ports 29** extend over at least the curved bottom portion of the trough.

Figure 4:
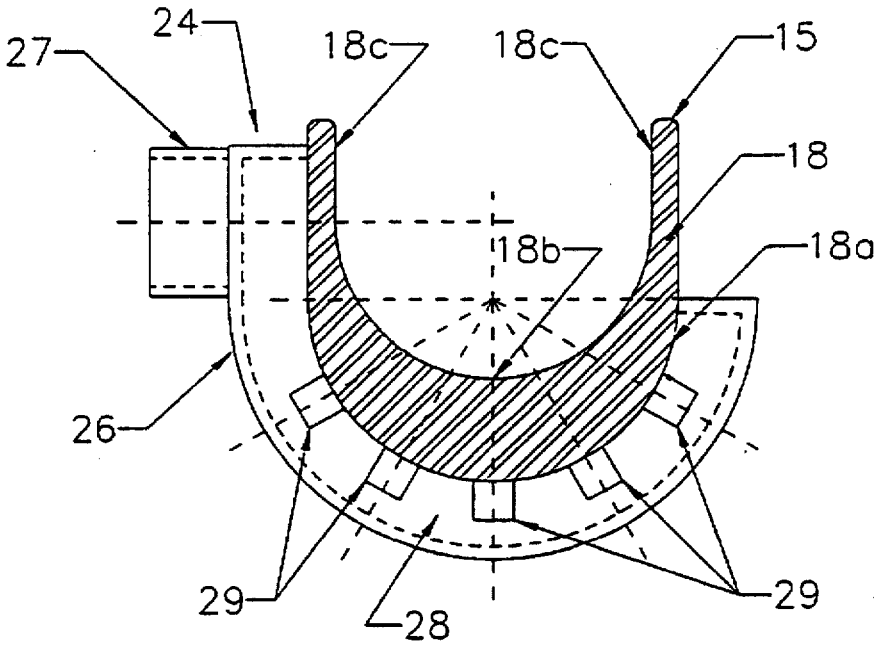
FIG. 4 is a sectional view taken generally on the line IV—IV in FIG. 3.

As best seen in FIG. 4, the trough 18 is of U-shaped profile having a lower curved part **18*b* where the thickness is a maximum, the trough tapering in thickness in opposite directions towards the upstanding limbs 18*c***.

The trough 18 is a casting formed of a refractory corrosion-resistant metal alloy, specifically a high chromium—high nickel alloy containing a small amount of niobium, such as IN-657 available from International Nickel Company which has a chromium content of 48–52%, niobium 1.4–1.7%, with the balance being nickel together with trace amounts of carbon, nitrogen, silicon, iron and manganese. This provides a satisfactory resistance to the extremely hot and corrosive flow of smelt passing from the furnace 11.

The spout 15 opens into a housing 31 beneath which is a dissolving tank 32. A so-called shatter nozzle 33 supported in the housing 31 delivers a spray of steam against the stream of smelt 34 flowing from the spout to break up this stream into small particles which fall downwards and are dissolved in liquid within the dissolving tank 32.

As illustrated, the mounting plate 17 is attached by any suitable means, such as by welding, to the trough 18 so that when installed the latter has a slight downwards inclination (as shown, about 8%) from its inlet to its outlet end to promote flow of smelt therethrough.

It will be understood that the flow of smelt is concentrated in the lower portion of the trough 18 and that the high temperature and corrosive nature of the smelt will over time result in significant wear and abrasion of the material of the trough. Clearly, reduction in the operating temperature of the smelt spout 15 is likely to be beneficial to the service life of the latter, and this temperature reduction is achieved by the cooling system described above. The cooling air is unchannelled once it has exited the ports 29, but due to the orientation of these, the cooling air passes in opposite directions longitudinally of the trough 18 and applies a cooling effect thereto. In practice, this cooling effect probably does not reduce the surface temperature where the trough 18 is contacted by the flow of smelt by more than about 100° F.±25° F. However even this results in a useful extension in the service life of the trough which otherwise would experience localized operating temperatures at or slightly above the limit of its useful temperature range and which otherwise would lead to rapid erosion and destruction of the trough.

In some installations the recovery furnace 11 will include two such spouts 15 in order to be able to handle the required throughput of smelt while still achieving a satisfactory service life for the spouts. In this arrangement, there are two holes 14 provided in the wall 10 of the furnace at horizontally spaced locations, each hole having mounted therein a smelt spout 15 in the manner described above, the spouts 15 being arranged so that they are at the same level, with the object of dividing the total flow of smelt evenly therebetween. However practical problems arise with such arrangements in that no matter how evenly matched the initial smelt flow as between the two spouts 15, unpredictable variants produce the result that gradually an increasing proportion of the smelt flow passes through one of the spouts. Any such increase once established is self-reinforcing since the increase in flow through the one spout will result in more abrasive wear at the bottom of the inlet of that spout thus lowering the effective level of that spout relative to the other spout and thus accelerating the imbalance. Thus the desired increase in service life is not achieved since the spout receiving the major portion of the smelt flow is eventually rendered unserviceable.

By utilizing air cooled spouts as described above in relation to FIGS. 1 through 5, the above problem can be alleviated that is once any mismatching of the smelt flows through the two spouts is observed, the cooling effect applied to the spout carrying the lesser smelt flow can be decreased or eliminated thus producing a more rapid wear of that spout and a tendency towards equalization of the flow rates. By continuous monitoring these flow rates and adjusting the cooling effects accordingly, the installation can be run to achieve maximum service life out of both spouts.

Figure 6:
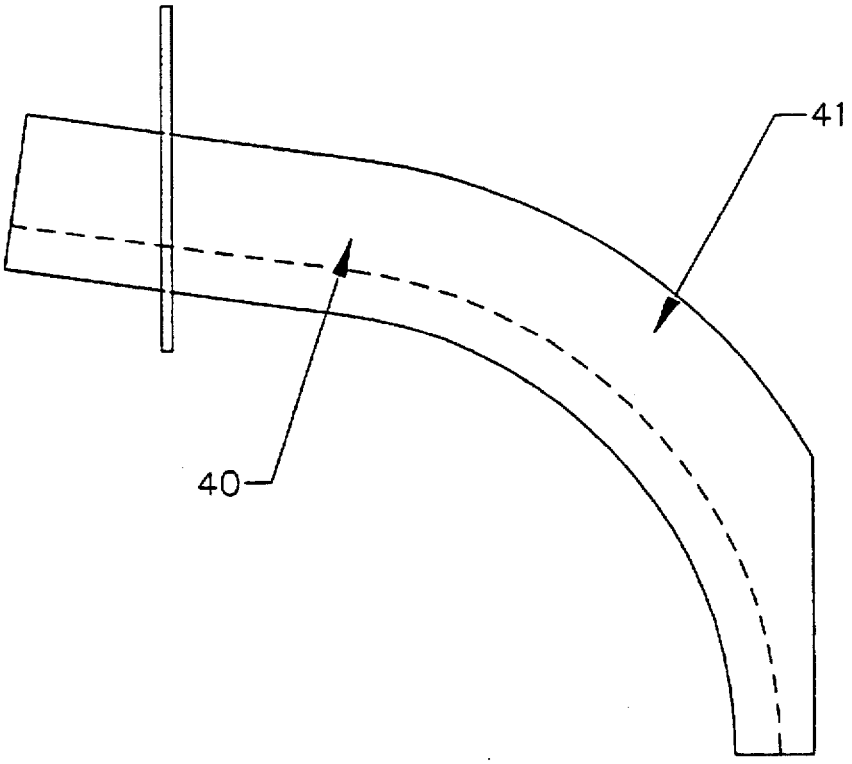
FIG. 6 is a view corresponding to FIG. 3 but showing an alternative spout configuration.

It will be appreciated that the trajectory followed by the smelt stream 34 leaving the end of the spout 15 will be dependent upon the flow rate of this stream, which in turn will be influenced by the throughput of the furnace 11, so that in normal operating conditions variations in the position of the stream 34 towards or away from the shattered nozzle 33 will occur. To eliminate or reduce these variations an alternative form of smelt spout 40 is shown in FIG. 6. Here, instead of the straight trough 18, there is a trough 41 that towards its downstream end curves downwardly so that at the end a flow of smelt through the trough will be directed substantially vertically throughout the range of smelt flow rates that will be encountered in practice.

What we claim as our invention is:

1. A smelt spout for delivering smelt from a chemical recovery furnace, said spout comprising:

a trough of U-shaped profile having a curved lower portion that is relatively thick in the central region thereof and tapers in thickness towards the upstanding limbs of the U-shape and fabricated as a casting of a nickel-chromium alloy.

2. A smelt spout as claimed in claim 1 wherein said alloy comprises from 48 to 52% chromium, 1.4 to 1.6% niobium, with the balance being nickel with minor amounts of trace elements and impurities.

3. A system for delivering smelt from a chemical recovery furnace, said system comprising at least one spout having an inlet end mounted in an opening of a wall of said furnace to channel smelt passing through said opening, said spout comprising a casting formed of a refractory and corrosion-resistant metal alloy, said system further including cooling means adapted to deliver a flow of cooling air against the outer surface of said spout, wherein the cooling means comprises a plenum positioned closely adjacent the outer surface of the spout and having passages directing said cooling air flow in opposite directions generally longitudinally of said spout and against said outer surface.

4. A system as claimed in claim 3 wherein said plenum is positioned close to the inlet end of said spout.

5. A chemical recovery furnace in combination with a smelt delivery system comprising at least one spout of U-shaped profile having a relatively thick curved lower section and thinner upwardly extending limbs, said spout having an inlet end that is mounted in an opening in a peripheral wall of the furnace to channel smelt passing through said opening, said spout comprising a casting formed of a refractory and corrosion-resistant metal alloy, said system including a cooling means adapted to deliver a flow of cooling air against the outer surface of said spout at least in a region adjacent the external side of said furnace wall.

6. The combination of claim 5 including at least two said spouts carried in respective openings at horizontally spaced locations in said peripheral wall, the flow of cooling air to the respective spouts being independently controllable so that the rate of wear of the spouts by the flow of smelt therein can be adjusted to achieve balanced flow through the different spouts.

7. The combination of claim 5 wherein said metal alloy is a chromium-nickel alloy having a small amount of niobium.

8. The combination of claim 11 wherein said alloy has the composition chromium 48–52% niobium 1.4 to 1.7% with the balance being nickel, apart from minor amounts of trace elements and impurities.

* * * * *